US009642451B2

(12) United States Patent
Okuda et al.

(10) Patent No.: US 9,642,451 B2
(45) Date of Patent: May 9, 2017

(54) FOLDING TABLE

(75) Inventors: Naoyuki Okuda, Kanagawa (JP); Kenji Nakamura, Kanagawa (JP)

(73) Assignee: OKAMURA CORPORATION, Kanagawa (JP)

( * ) Notice: Subject to any disclaimer, the term of this patent is extended or adjusted under 35 U.S.C. 154(b) by 1046 days.

(21) Appl. No.: 13/880,660

(22) PCT Filed: Oct. 26, 2011

(86) PCT No.: PCT/JP2011/074714

§ 371 (c)(1),
(2), (4) Date: Jun. 28, 2013

(87) PCT Pub. No.: WO2012/057225

PCT Pub. Date: May 3, 2012

(65) Prior Publication Data

US 2013/0284076 A1 Oct. 31, 2013

(30) Foreign Application Priority Data

Oct. 27, 2010 (JP) ..... 2010-240410
Nov. 5, 2010 (JP) ..... 2010-248298
(Continued)

(51) Int. Cl.
*A47B 3/00* (2006.01)
*A47B 3/08* (2006.01)
*A47B 13/06* (2006.01)

(52) U.S. Cl.
CPC ..... *A47B 3/08* (2013.01); *A47B 3/0818* (2013.01); *A47B 13/06* (2013.01)

(58) Field of Classification Search
CPC ..... A47B 33/00; A47B 33/0818; A47B 13/06; A47B 3/00; A47B 3/0818
(Continued)

(56) References Cited

U.S. PATENT DOCUMENTS 5,205,223 A * 4/1993 Ball ..... A47B 3/0803 108/115
5,927,214 A * 7/1999 Schwartz ..... A47B 3/0815 108/115
(Continued)

FOREIGN PATENT DOCUMENTS

JP 8-154742 6/1996
JP 09-191941 7/1997
(Continued)

OTHER PUBLICATIONS

International Search Report issued in International Patent Application No. PCT/JP2011/074714 dated Jan. 17, 2012.

*Primary Examiner* — Jose V Chen
(74) *Attorney, Agent, or Firm* — McDermott Will & Emery LLP

(57) ABSTRACT

Provided is a folding table for which a work of installing leg units on a tabletop is simplified, and squeaking and rattling are prevented even when the tabletop is used for a long period of time, so that the tabletop can be rotated smoothly. A protruding portion that protrudes in a horizontal direction is integrally formed on a bracket. By providing, on an upper portion of the leg units, a fitting hole into which the protruding portion fits and fitting the protruding portion into the fitting hole while crimping a distal end of the protruding portion in the horizontal direction, the bracket is connected to the leg units, and the tabletop is rotated using the protruding portion as a rotating shaft.

5 Claims, 12 Drawing Sheets

(30) Foreign Application Priority Data

Nov. 5, 2010 (JP) ..... 2010-248299
Nov. 5, 2010 (JP) ..... 2010-248300

(58) Field of Classification Search
USPC ..... 108/115, 6, 8; 248/188.6, 188.1
See application file for complete search history.

(56) References Cited

U.S. PATENT DOCUMENTS 6,192,808 B1 * 2/2001 Bue ..... A47B 3/0911 108/1
6,336,414 B1 * 1/2002 Stewart ..... A47B 3/0815 108/115
6,637,352 B1 * 10/2003 Thode ..... A47B 3/08 108/115
7,066,098 B2 * 6/2006 Blasen ..... A47B 7/02 108/115
7,614,351 B2 * 11/2009 Piretti ..... A47B 3/0815 108/1
7,631,604 B2 * 12/2009 Huang ..... A47B 3/08 108/115
8,069,795 B1 * 12/2011 Williams ..... A47B 3/00 108/115
8,091,488 B2 * 1/2012 Chirea ..... A47B 3/08 108/115
8,171,863 B2 * 5/2012 Nyenhuis ..... A47B 5/00 108/115
8,272,336 B2 * 9/2012 Rutz ..... A47B 3/08 108/115
8,291,830 B2 * 10/2012 Rutz ..... A47B 3/0818 108/115
2004/0083932 A1 * 5/2004 Kottman ..... A47B 3/00 108/115
2007/0261609 A1 11/2007 Kumazawa
2007/0261611 A1 * 11/2007 Kumazawa ..... A47B 3/0815 108/115
2007/0262214 A1 11/2007 Kumazawa
2007/0262545 A1 11/2007 Kumazawa
2008/0295742 A1 * 12/2008 Henriott ..... A47B 21/00 108/6
2009/0283020 A1 * 11/2009 Hsu ..... A47B 3/0815 108/115
2011/0017107 A1 * 1/2011 Ko ..... A47B 3/0818 108/64
2011/0139042 A1 * 6/2011 Korb ..... A47B 3/00 108/115
2011/0290159 A1 * 12/2011 Saito ..... A47B 3/08 108/115

FOREIGN PATENT DOCUMENTS

JP 2006-102012 A 4/2006
JP 2007-260286 A 10/2007
JP 2007-301302 A 11/2007
JP 2009-039457 A 2/2009
JP 2009-061265 A 3/2009

* cited by examiner

FOLDING TABLE

FIELD

The present invention relates to a folding table in which a bracket is pivotally supported about a shaft center facing a horizontal direction on an upper portion of leg units, the bracket is connected to a lower surface of a tabletop to support the tabletop, and the tabletop is rotatable between a horizontal use position and a standing folding position.

BACKGROUND

Heretofore, in a coupled structure between a tabletop and leg units of a table (desk) used in an office and the like, hole portions are formed in both a bracket connected to the tabletop and a connection board connected to the leg units, and a pivot is inserted into the hole portions, so that the tabletop is rotatably supported by the leg units (for example, see Patent Literature 1). In addition, there is a table in which a shaft is included on an upper portion of leg units, the shaft is inserted into a shaft receiving hole such as an upper arm (bracket) and the like, the shaft is fixed by being connected to a connection lever by a screw member such as a bolt and the like, and a tabletop is supported by the upper arm (for example, see Patent Literature 2).

CITATION LIST

Patent Literature

Patent Literature 1: Japanese Patent Application Laid-open No. 2006-102012 (Page 4, FIGS. 5 and 6)

Patent Literature 2: Japanese Patent Application Laid-open No. 2009-39457 (Page 5, FIGS. 7 and 8)

SUMMARY

Technical Problem

However, in the tables of Patent Literatures 1 and 2, a screw member or a pivot inserted into a hole portion of a tabletop and leg units is used as a connection unit that connects the tabletop to the leg units. Thus, at the time of manufacturing a table, there is a concern that the number of components, screw members, and mounting operations of attaching a pivot increase, and a screw member is loosened when a load on a tabletop is supported for a long period of time, which causes squeaking and rattling when the tabletop is used, so that there is a problem that the tabletop may not be smoothly rotated.

The invention is conceived in view of the problem, and an object of the invention is to provide a folding table for which the work of installing the leg units on the tabletop is simplified, squeaking and rattling are prevented even when the tabletop is used for a long period of time, and the tabletop may be rotated smoothly.

Solution to Problem

To solve the problem described above, in a folding table according to the present invention, a bracket is pivotally supported about a shaft center facing a horizontal direction on an upper portion of a leg unit, the bracket is connected to a lower surface of a tabletop to support the tabletop, and the tabletop is rotatable between a horizontal use position and a standing folding position, wherein a protruding portion that protrudes in the horizontal direction is integrally formed on the bracket, a fitting hole into which the protruding portion is fitted is provided on the upper portion of the leg unit, the protruding portion is fitted into the fitting hole, and a distal end of the protruding portion is crimped in the horizontal direction, thereby the bracket is connected to the leg unit and the tabletop is rotated by using the protruding portion as a rotating shaft.

Moreover, in the folding table according to the present invention, a connection member is provided on the upper portion of the leg unit, the connection member includes a pair of left and right board members connected to each other in which corresponding circular openings having a circular shape are formed, and the both circular openings serve as the fitting hole.

Moreover, in the folding table according to the present invention, a space portion is formed between the pair of left and right board members.

Moreover, in the folding table according to the present invention, an edge of a circular opening of at least one board member of the both board members is extended in the horizontal direction.

Moreover, in the folding table according to the present invention, the edge of the circular opening of at least one board member of the both board members is extended toward the other board member, and comes into contact with the other board member.

Advantageous Effects of Invention

A folding table according to the present invention is a folding table in which a bracket is pivotally supported about a shaft center facing a horizontal direction on an upper portion of leg units, the bracket is connected to a lower surface of a tabletop to support the tabletop, and the tabletop may rotate between a horizontal use position and a standing folding position. A protruding portion that protrudes in the horizontal direction is integrally formed on the bracket. By providing, on the upper portion of the leg units, a fitting hole into which the protruding portion is fitted and fitting the protruding portion into the fitting hole while crimping the distal end of the protruding portion in the horizontal direction, the bracket is connected to the leg units, and the tabletop is rotated using the protruding portion as a rotating shaft. As such, the tabletop may be connected to the leg units through an operation of crimping the distal end of the protruding portion by fitting the protruding portion, which is integrally formed with the bracket, to the fitting hole on the upper portion of the leg units, and thus the work of installing the leg units on the tabletop may be simplified. In addition, when the protruding portion is crimped in the horizontal direction, a deformation direction due to the crimping is different from a direction in which a load of the tabletop is applied in the protruding portion, and a portion deformed by the crimping is less influenced at the time of rotating the tabletop in the protruding portion. Accordingly, squeaking and rattling are prevented even when the tabletop is used for a long period of time, and the tabletop may be rotated smoothly.

In the folding table according to the present invention, a connection member is provided on an upper portion of the leg units, the connection member includes a pair of left and right board members connected to each other, in which corresponding circular openings having a circular shape are formed, and the both circular openings serve as the fitting hole. In general, the leg units are formed by an extrusion molding of a rigid body and the like to support a load of the tabletop and the like. The connection member may be formed as a different member from the leg units even though design accuracy fluctuates. In addition, when the circular openings are formed in the pair of left and right board members, it is possible to open the fitting hole having high design accuracy.

A space portion is formed between the pair of left and right board members in a folding table according to the present invention. As such the connection member has a thickness, and thus a light connection member may be formed while strength of the connection member is enhanced.

In the folding table according to the present invention, an edge of a circular opening of at least one board member of the both board members is extended in a horizontal direction. As such, an inner periphery of the fitting hole may be widely formed, and the tabletop may be smoothly rotated by supporting a load applied to the inner periphery of the fitting hole from the protruding portion in a large area.

In the folding table according to the present invention, an edge of a circular opening of at least one board member of the both board members is extended toward the other board member, and comes into contact with the other board member. As such, a neighborhood of the fitting hole of the connection member provided with a space portion therein is rarely crushed in a thickness direction of the connection member, and strength is enhanced.

BRIEF DESCRIPTION OF DRAWINGS

FIG. 7-1 is an enlarged longitudinal cross-sectional view taken along line A-A of FIG. 4.

FIG. 7-2 is an enlarged longitudinal cross-sectional view taken along line B-B of FIG. 4.

FIG. 9-1 is an enlarged longitudinal side view illustrating the bracket and the leg units, and illustrates a state in which the tabletop is in a use position.

FIG. 9-2 is an enlarged longitudinal side view illustrating the bracket and the leg units, and illustrates a state in which the tabletop is in a folding position.

DESCRIPTION OF EMBODIMENTS

Implementation of a folding table according to the present invention will be described based on an embodiment.

Embodiment

Figure 1:
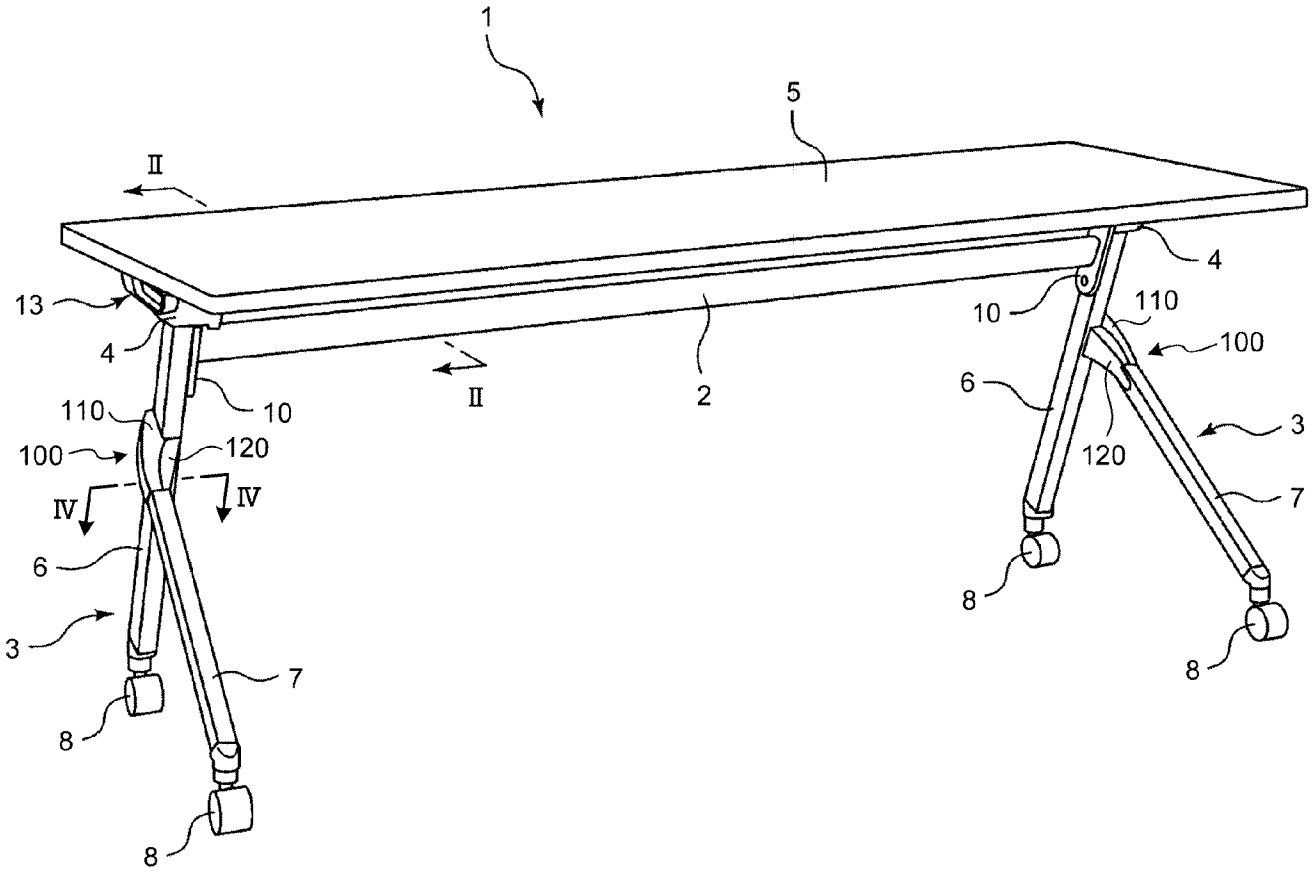
FIG. 1 is a perspective view of a folding table according to the present invention.

FIG. 1 is a perspective view of a folding table when seen from the front in an oblique direction, which serves as furniture in the embodiment to which the invention is applied. Hereinafter, description will be made on the assumption that a left side on the paper of FIGS. 2 to 4, and FIGS. 9-1 and 9-2 corresponds to a front side (forward side) of a folding table 1, and a left side on the paper of FIGS. 5 to 7-2 corresponds to an outside of the folding table 1. The folding table 1 includes a pair of left and right leg units 3 and 3 including facing surfaces on top end portions connected to each other by a connection lever 2, and a tabletop 5 attached to a pair of left and right brackets 4 and 4 rotatably attached to top end portions of the both leg units 3 such that the tabletop 5 may rotate between a horizontal use position and a standing folding position on a rear side of the leg unit 3.

The left and right leg units 3 and 3 include a vertical rear leg 6 that inclines toward a front side in an oblique direction, and a front leg 7 facing a front and lower side in an oblique direction and including a top end portion (rear end portion) adhered to an external surface of an intermediate portion in a vertical direction of the rear leg 6 such that an approximate reversed shape of a letter "Y" is formed in lateral view, and a caster 8 is attached to lower ends of the rear leg 6 and the front leg 7.

Figure 2:
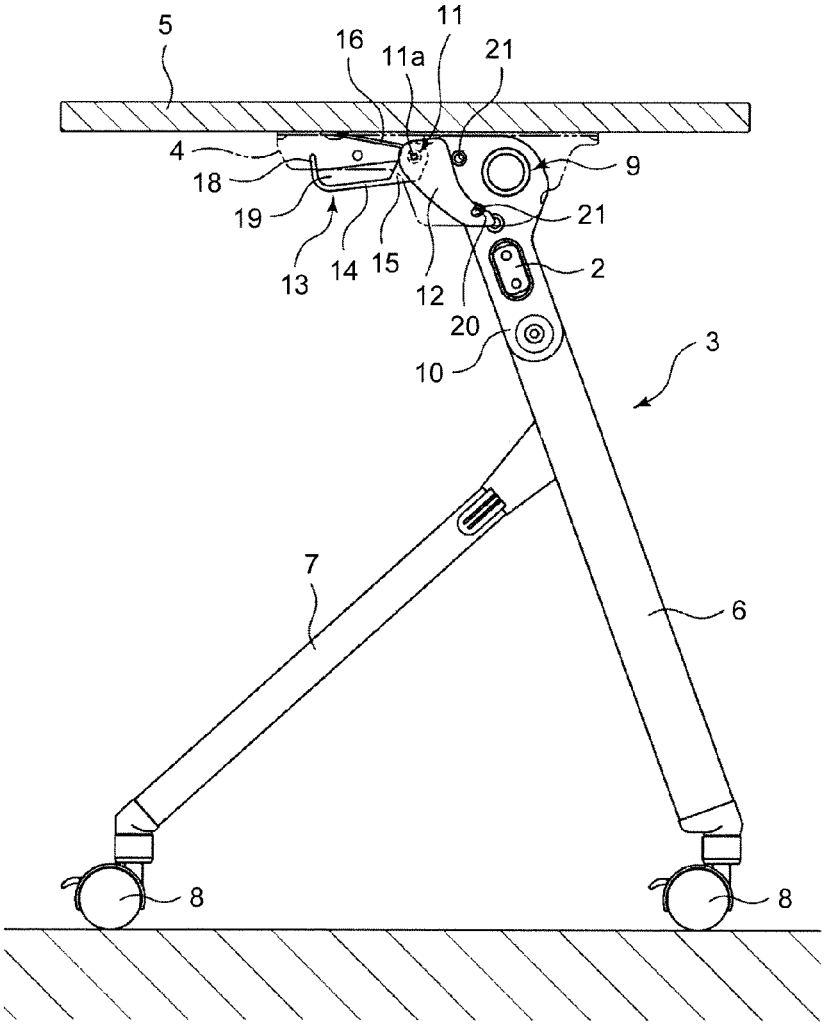
FIG. 2 is a longitudinal side view taken along line II-II of FIG. 1.
Figure 3:
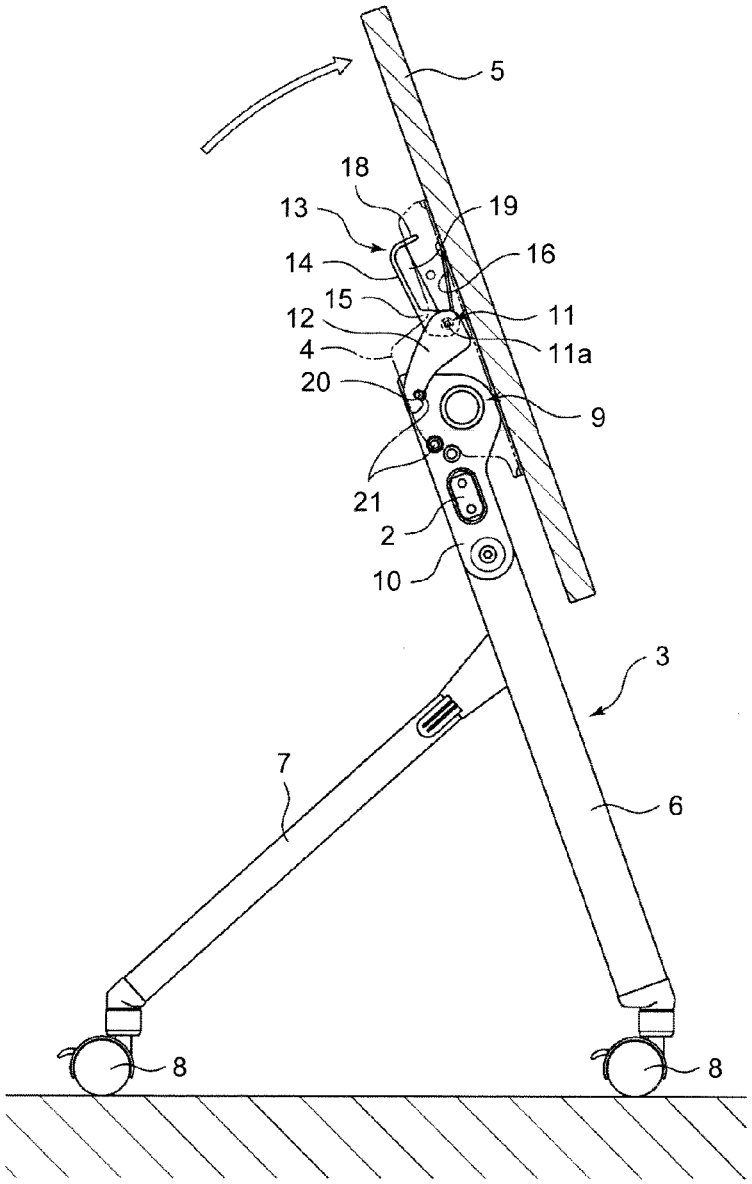
FIG. 3 is a longitudinal side view taken along line II-II of FIG. 1 when a tabletop is stood in a folding position.

As illustrated in FIGS. 2 and 3 which are enlarged longitudinal side views taken along line II-II of FIG. 1, the left and right brackets 4 are provided with a rotating shaft 9 facing in a left-right direction (horizontal direction) of the tabletop 5, and the bracket 4 is rotatably supported on the rotating shaft 9. The bracket 4 is illustrated in a two-dot chain line to facilitate the understanding of a connection state of a locking lever 12 and a connection member 10 to be described below. The connection member 10 is adhered to a top end portion of an inside surface of the rear leg 6 in the leg unit 3, and both ends of the connection lever 2 described above are adhered to the connection member 10.

Both ends of an operation shaft 11 facing in a left-right direction are rotatably supported on a top end portion slightly approaching the front of the left and right brackets 4. In addition, a top end portion of the locking lever 12 serving as an engaging unit that locks the tabletop 5 in a use position, and releases the lock is fitted to a square shank portion 11*a* formed on the both ends of the operation shaft 11 such that the top end portion may not relatively rotates.

In addition, a pair of left and right operating devices 13 are non-rotatably attached to an axial end portion protruding from the left and right brackets 4 in the square shank portion 11*a*. The left and right brackets 4 provided with the locking lever 12 and the left and right leg units 3 provided with the connection member 10 have bilateral symmetry and the same structure. Thus, hereinafter, the left and right leg units 3 and brackets 4 will be only described.

Figure 4:
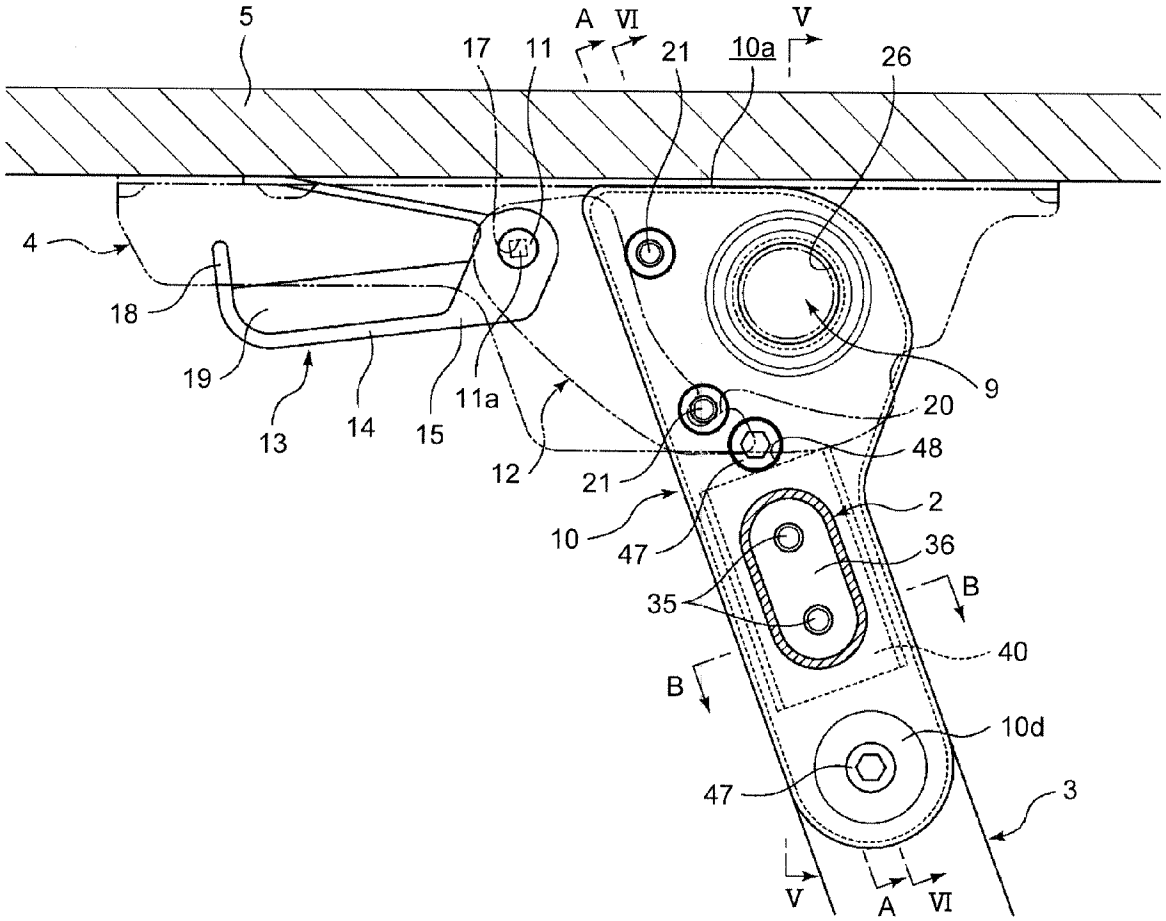
FIG. 4 is an enlarged longitudinal side view of a connection member.

As illustrated in FIG. 4, the operating device 13 includes an operating portion 14 in a shape of a plate which is long in a front-rear direction, and an elastically deformable flexible portion 16 connected to a front surface of a top end portion of a thick proximal end 15, facing the rear and the upper side, which is connected to a rear end portion of the operating portion 14 so as to be separated from and face an upper surface of the operating portion 14. The entire operating device 13 is integrally formed using a polyamide-based synthetic resin. A rectangular shaft hole 17, in which the square shank portion 11*a* of the operation shaft 11 fits with a pressure, is formed in the proximal end 15.

A stopper portion 18, which regulates a maximum amount of upward rotation of the operating portion 14 using an upper end (tip) coming into contact with a lower surface of the tabletop 5, is upwardly connected to a front end of the operating portion 14. A front-end size of the flexible portion 16 has a length at which the upper end of the stopper portion 18 does not come into contact with a lower surface of a front end portion thereof.

A reinforced piece 19, which faces a front-rear direction and includes both front and rear ends combined with a facing surface of the proximal end 15 and the stopper portion 18, is integrally installed on an upper surface of a central part of the operating portion 14 to protrude upward. Bending rigidity of the operating portion 14 is increased so that only the flexible portion 16 may be elastically deformed in an effective manner.

As illustrated in FIG. 2, the proximal end 15 of the operating device 13 is connected to the operation shaft 11 in a state in which an initial added force is applied so that an upper surface of a front end portion of the flexible portion 16 is pressed against the lower surface of the tabletop 5. Thus, the operating portion 14 is urged downward (counterclockwise direction) by an elastic repulsive force of the flexible portion 16, and is maintained at an original position.

In addition, likewise, the locking lever 12 non-rotatably fitted to the square shank portion 11*a* is urged in a counterclockwise direction by an elastic repulsive force of the flexible portion 16, and is maintained at a lock position which is a fixed position. In this way, an arc-shaped lock groove 20 formed on an upper surface of a lower end portion of the locking lever 12 is engaged with a lock pin 21 on a lower side installed on an inside surface of the connection member 10 in a protruding manner, and the tabletop 5 is non-rotatably locked at a use position.

When the operating portion 14 is rotated upward while the flexible portion 16 is elastically deformed in a state in which the tabletop 5 is at a use position, the locking lever 12 together with the operation shaft 11 is rotated in a clockwise direction, and is rotated from a fixed position up to an operating position. As a result, the lock groove 20 of the locking lever 12 is separated from the lock pin 21. In this way, a lock of the tabletop 5 is released to enable the tabletop 5 to rotate, and the tabletop 5 may be rotated upward up to a folding position.

As illustrated in FIG. 3, when a hand is removed from the operating portion 14 in a state in which the tabletop 5 is at a folding position, the locking lever 12 together with the operating portion 14 is rotated up to an original fixed position by an elastic repulsive force of the flexible portion 16. As a result, the lock groove 20 of the locking lever 12 is engaged with the lock pin 21 provided in a top end portion of the connection member 10, and the tabletop 5 is non-rotatably locked at a folding position.

When the operating portion 14 is rotated again to release a lock and enable the tabletop 5 to rotate in a folding position of the tabletop 5, and the tabletop 5 is rotated up to a horizontal position to remove a hand from the operating portion 14, the locking lever 12 together with the operating portion 14 is rotated in a counterclockwise direction by an elastic repulsive force of the flexible portion 16, and the lock groove 20 of the locking lever 12 is engaged with the lock pin 21 on a lower portion. Thus, the tabletop 5 is non-rotatably locked in a use position. A locking unit of this embodiment includes two upper and lower lock pins 21 from which the locking lever 12, serving as an engaging unit, is disengaged, and the connection member 10 provided with the lock pins 21.

Next, the bracket 4 and the connection member 10 will be described. As illustrated in FIG. 4, the connection member 10 extends in a longitudinal direction of the leg unit 3. In addition, a lower portion thereof has the substantially same front-rear size as the leg unit 3, and an upper portion thereof has a wide profile in which a width increases upwardly. The bracket 4 and the locking lever 12 are illustrated in two-dot chain lines to facilitate the understanding of a connection state of the bracket 4 and the connection member 10 to be described below.

Figures 1, 7:
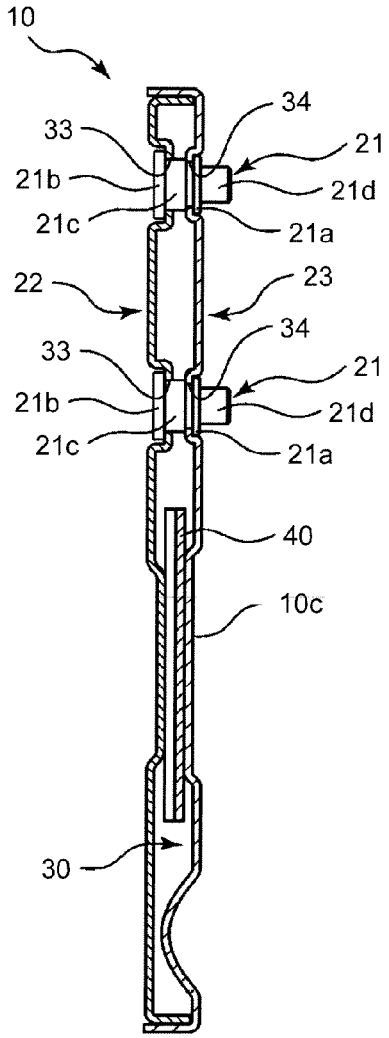
Figures 2, 7:
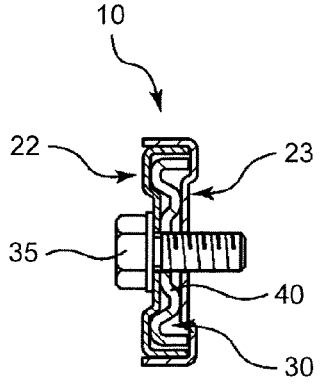

The connection member 10 forms a shape of an approximate plate to which a pair of left and right board members 22 and 23 are connected (see FIG. 7-1). Further, edges of the left and right board members 22 and 23 are bent. In addition, the other board member 22 is fitted to one board member 23, and the board members 22 and 23 are connected to each other by welding the edges of both the board members 22 and 23 together.

Figure 5:
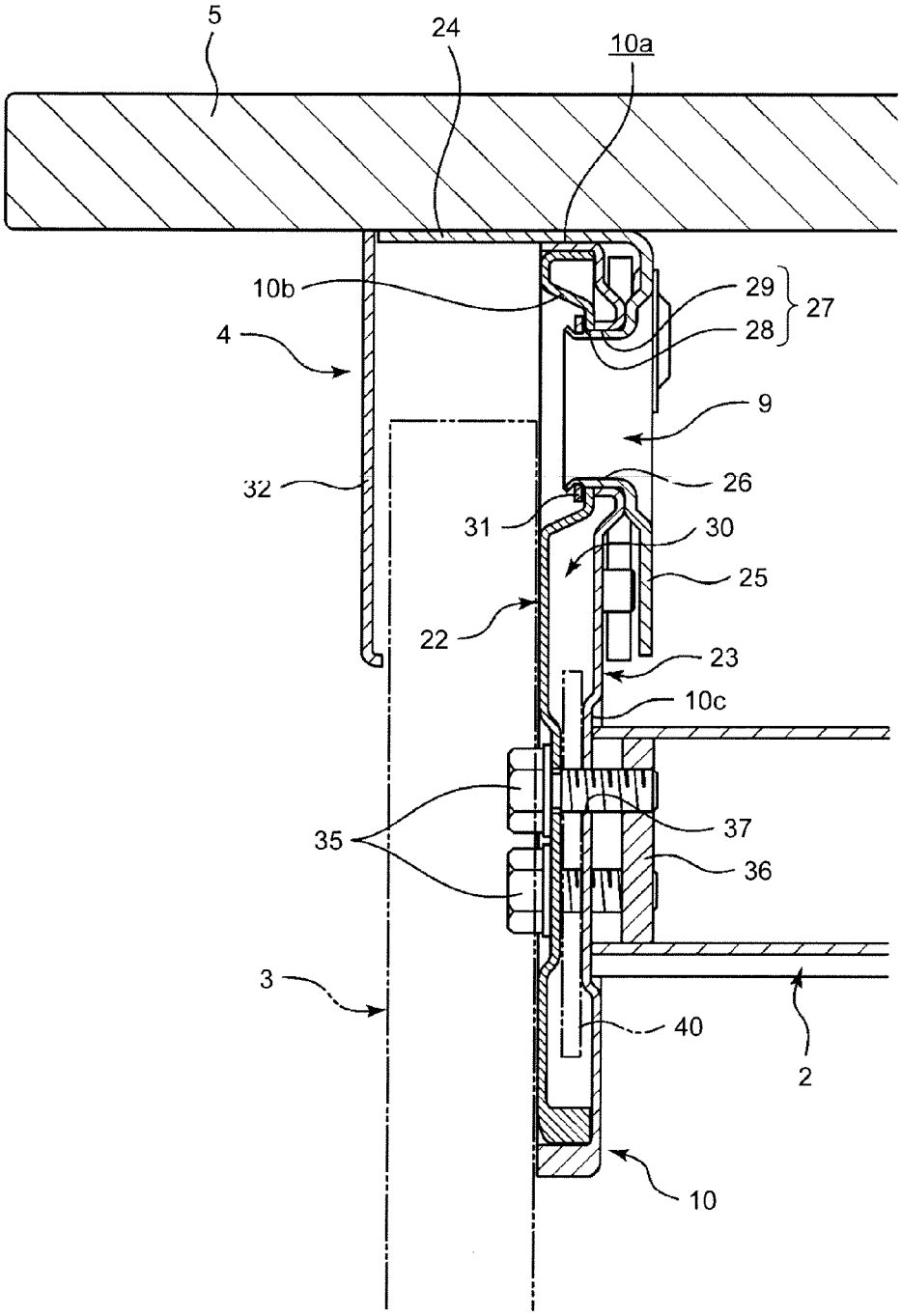
FIG. 5 is an enlarged longitudinal side view taken along line V-V of FIG. 4.

As illustrated in FIG. 5, the bracket 4 includes a horizontal piece 24 which is connected to the lower surface of the tabletop 5, and forms an approximate shape of a plate that horizontally extends, and a downward piece 25 that forms an approximate shape of a plate extending downward from the horizontal piece 24. The bracket 4 forms an approximate shape of a letter "L" in a longitudinal front view. The leg unit 3 is illustrated in a two-dot chain line. In addition, an upper surface of the connection member 10 is a horizontal surface 10*a* (contact surface) that is approximately horizontal. When the tabletop 5 is in a user position, a lower surface of the horizontal piece 24 of the bracket 4 comes into contact with the horizontal surface 10*a* of the connection member 10.

A protruding portion 26 protruding in a horizontal direction (outward) from the downward piece 25 is formed on the bracket 4. The protruding portion 26 forms an approximate cylindrical shape, and protrudes from the downward piece 25. In addition, a diameter thereof is greater than a protrusion size. The protruding portion 26 is integrally formed on the downward piece 25 by press working and the like. In addition, a thin wall portion 10*b* having a small thickness is formed on an upper portion of the connection member 10, and a circular fitting hole 27, to which the protruding portion 26 of the bracket 4 is fitted, is opened in the thin wall portion 10*b*.

The fitting hole 27 has an inner diameter which is the substantially same as an outer diameter of the protruding portion 26. In addition, corresponding circular openings 28 and 29 having a circular shape are formed in the left and right board members 22 and 23 included in the connection member 10, and the both circular openings 28 and 29 serve as the fitting hole 27 when the both board members 22 and 23 are connected to each other. In addition, as described in the foregoing, when an edge of each of the board members 22 and 23 is bent, a space portion 30 is formed between the both board members 22 and 23, and facing surfaces of the both board members 22 and 23 are separated from each other.

Further, an edge of the circular opening 29 of the board member 23 on the right side (inside) of the both board members 22 and 23 is extended in a horizontal direction toward an edge of the circular opening 28 of the board member 22 on the left side (outside), and comes into contact with the edge of the circular opening 28. An inner periphery of the fitting hole 27 is formed by the extended edge of the circular opening 29 of the board member 23.

As illustrated in FIG. 5, the protruding portion 26 of the bracket 4 is rotatably fitted to the fitting hole 27 of the connection member 10, and the bracket 4 is connected to the connection member 10 when a distal end thereof is crimped in an axial direction (horizontal direction) of the protruding portion 26. A ring-shaped ring member 31 is disposed between the distal end of the protruding portion 26 and the edge of the fitting hole 27, and the protruding portion 26 may freely rotate within the fitting hole 27 even when the distal end of the protruding portion 26 is crimped. The protruding portion 26 and the fitting hole 27 are included in the rotating shaft 9 which pivotally supports and rotates the tabletop 5, and includes a shaft center facing a horizontal direction (left-right direction).

Figure 8:
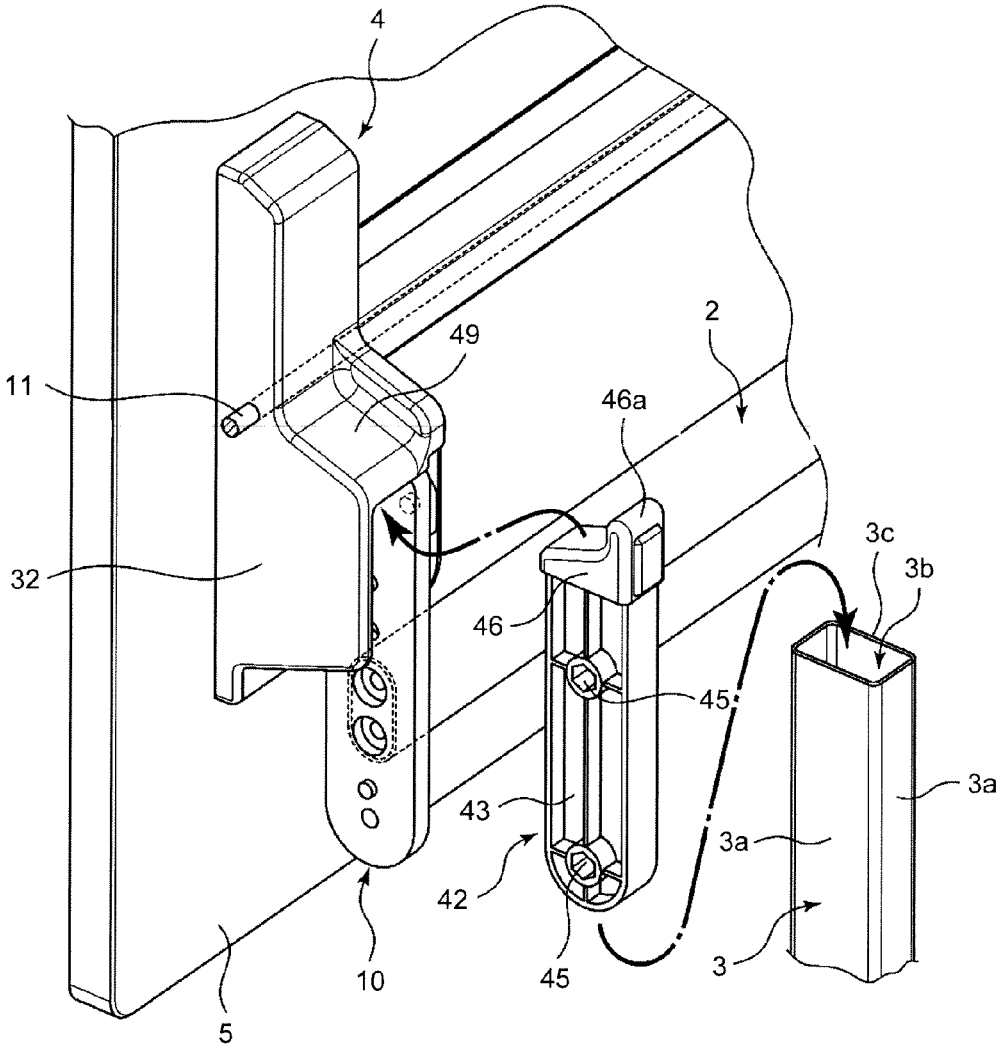
FIG. 8 is an exploded perspective view illustrating a bracket and leg units.

A cover piece 32 that is substantially parallel to the downward piece 25 described above and covers the protruding portion 26 and the fitting hole 27 is formed on the bracket 4 (see FIG. 8). The protruding portion 26 and the fitting hole 27 included in the rotating shaft 9 are disposed between the downward piece 25 and the cover piece 32. The protruding portion 26 and the fitting hole 27 are hidden from the outside by the cover piece 32, and thus an appearance of the folding table 1 may be improved.

As illustrated in FIG. 7-1, two upper and lower hole portions 33 and 34, to which the lock pin 21 described above is fitted, are formed in the respective left and right board members 22 and 23 included in the connection member 10. The respective upper and lower hole portions 33 and 34 are formed in corresponding positions in the respective left and right board members 22 and 23, and the shaft center of the hole portion 34 of one board member 23 is identical to a shaft center of the hole portion 33 of the other board member 22. The lock pin 21 is non-detachably fitted to the respective hole portions 33 and 34 from the outside of the connection member 10, and a protrusion side (one end side) of the lock pin 21 is crimped in an axial direction (left-right direction) thereof, thereby causing a base portion 21*a* of a protruding portion of the lock pin 21 to bulge out and be fixed to the hole portion 34.

Specifically, the lock pin 21 before being inserted into the hole portions 33 and 34 includes a large diameter portion 21*b* having a large diameter, an intermediate diameter portion 21*c* having a slightly smaller diameter than the diameter of the large diameter portion 21*b*, and a small diameter portion 21*d* having the smallest diameter, and has an appearance in which a diameter decreases toward an insertion direction. When the lock pin 21 is inserted into the hole portions 33 and 34, the intermediate diameter portion 21*c* thereof is locked in an edge of the inside of the hole portion 34 of the board member 23 on the inside (right side), and the large diameter portion 21*b* is locked in an edge of the outside of the hole portion 33 of the board member 22 on the outside (left side).

In this state, the small diameter portion 21*d* protrudes toward the inside (right side) of the connection member 10. When the protruding portion is crimped in an axial direction (left-right direction) thereof, a diameter of the small diameter portion 21*d* further decreases, and the base portion 21*a* of the small diameter portion 21*d* bulges out in a radial direction. The base portion 21*a* is locked in an edge of the outside of the hole portion 34 of the board member 23 on the inside (right side). The lock pin 21 is fixed to the hole portion 34 of the board member 23 on the inside (right side) by the base portion 21*a* and the intermediate diameter portion 21*c*.

Figure 6:
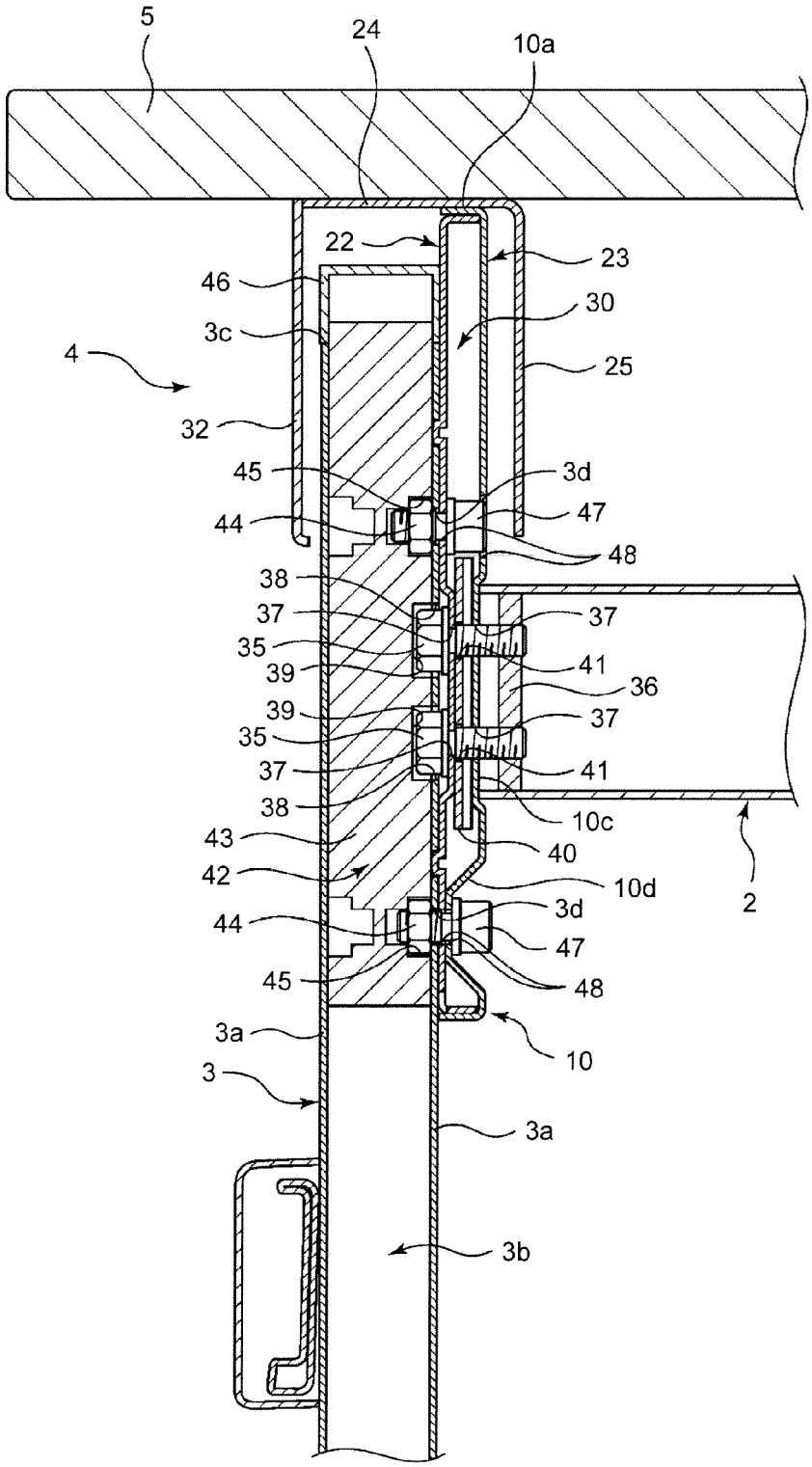
FIG. 6 is an enlarged longitudinal side view taken along line VI-VI of FIG. 4.

As illustrated in FIG. 6, an end portion of the connection lever 2 described above is adhered to the connection member 10 by a hexagonal headed bolt 35. The connection lever 2 forms a long circular shape in a cross-sectional view, and the inside is hollow (see FIG. 4). A clamped plate 36 including an internal thread portion that screws the hexagonal headed bolt 35 is welded to the inner circumference.

In addition, a bolt insertion hole 37 that inserts the hexagonal headed bolt 35 is formed in the connection member 10. Before the connection member 10 is attached to the leg unit 3, the hexagonal headed bolt 35 is inserted into the bolt insertion hole 37, and an external thread portion thereof is screwed to the internal thread portion of the clamped plate 36 of an edge of the connection lever 2. An opening hole 38 where a rectangular head of the hexagonal headed bolt 35 is disposed is formed in the leg unit 3, and a concave portion 39 where the rectangular head of the hexagonal headed bolt 35 is disposed is formed in an arrangement member 42 to be described below.

In addition, a part where the bolt insertion hole 37 of the connection member 10 is formed is a thin wall portion 10*c* having a small thickness. Further, a reinforced plate 40 is disposed in the space portion 30 corresponding to the thin wall portion 10*c*, that is, a position where the connection lever 2 of the connection member 10 is screwed. The reinforced plate 40 forms an approximate wave shape in a cross-sectional view due to a rectangular metal plate that is bent (see FIG. 7-2), and includes a part facing in a width direction (thickness direction) of the connection member 10. The bent reinforced plate 40 comes into contact with inner surfaces of the pair of left and right board members 22 and 23, respectively.

In addition, a bolt insertion hole 41, into which the hexagonal headed bolt 35 used to connect the connection lever 2 described above is inserted, is formed in the reinforced plate 40. The reinforced plate 40 is adhered to the board member 23 on the inside (right side) by a bonding unit such as welding before the left and right board members 22 and 23 are connected to each other.

Next, a coupled structure of the leg unit 3 and the connection member 10 is described in detail. As described in FIG. 6, the leg unit 3 includes a wall portion 3*a* and a hollow portion 3*b* surrounded by the wall portion 3*a*, and is a prismatic member having a rectangular cross-sectional surface. As described in FIG. 8, a top surface opening 3*c* leading to the hollow portion 3*b* is formed on an upper surface of the leg unit 3. The arrangement member 42 is inserted into the hollow portion 3*b* from the top surface opening 3*c*.

The arrangement member 42 is provided with an inserted portion 43 which is inserted into the hollow portion 3*b* of the leg unit 3, and a nut arrangement hole 45 non-rotatably disposing a hexagon nut 44 serving as an internal thread member is formed in an approximate central part and a lower portion in a vertical direction of the inserted portion 43. In addition, a lower end portion of the inserted portion 43 is rounded so that the arrangement member 42 is easily inserted from the top surface opening 3*c*.

Further, the arrangement member 42 is inserted from the top surface opening 3*c* in a state in which the hexagon nut 44 is disposed in the respective upper and lower nut arrangement holes 45. An outside size of the inserted portion 43 is the substantially same as an inside size of the leg unit 3, so that the arrangement member 42 inserted into the hollow portion 3*b* of the leg unit 3 does not shake.

As illustrated in FIGS. 6 and 8, an upper portion of the arrangement member 42 is a blocking portion 46 that blocks the top surface opening 3*c* of the leg unit 3. An outside size of the blocking portion 46 is slightly greater than the inside size of the leg unit 3, and the blocking portion 46 is locked in an edge of the top surface opening 3*c* when the inserted portion 43 of the arrangement member 42 is inserted from the top surface opening 3*c* of the leg unit 3.

As illustrated in FIGS. 8, 9-1 and 9-2, the blocking portion 46 of the arrangement member 42 protrudes upward from the top surface opening 3*c* of the leg unit 3, and the blocking portion 46 forms an approximate shape of a letter "L" in lateral view including a standing piece 46*a* that stands upward on a front side thereof. Further, an upper end of the standing piece 46*a* is grounded.

As illustrated in FIG. 4, a bolt insertion hole 48, into which a cap bolt 47 (bolt including a hexagon socket) serving as an external thread member used to attach the connection member 10 to the leg unit 3 is inserted, is formed in an approximate central part and a lower portion of the connection member 10. As illustrated in FIG. 6, the bolt insertion hole 48 is opened in a corresponding position of the left and right board members 22 and 23 included in the connection member 10.

The bolt insertion hole 48 of an upper portion formed in the board member 23 on the inside (right side) is greater than the bolt insertion hole 48 of an upper portion formed in the board member 22 on the outside (left side). A head portion of the cap bolt 47 inserted into each bolt insertion hole 48 of the upper portion is disposed on the inside of the space portion 30 of the connection member 10 by passing through the bolt insertion hole 48 formed in the board member 23 on the inside (right side), and the cap bolt 47 is locked in an edge of the bolt insertion hole 48 formed in the board member 22 on the outside (left side). In addition, the cap bolt 47 inserted into each bolt insertion hole 48 of the lower portion is disposed in a thin wall portion 10*d* of the connection member 10, and is locked in an edge of the bolt insertion hole 48 formed in the board member 23 on the inside (right side).

In addition, an insertion hole 3*d*, into which an external thread portion of the cap bolt 47 is inserted, is formed in the wall portion 3*a* on the inside (right side) among the front, rear, left, and right wall portions 3*a* of the leg unit 3. As described in the foregoing, when the blocking portion 46 of the arrangement member 42 is locked in the edge of the top surface opening 3*c*, the upper and lower nut arrangement holes 45 provided in the inserted portion 43 of the arrangement member 42 are positioned at locations corresponding to the upper and lower insertion holes 3*d* of a wall portion of the leg unit 3, respectively.

As illustrated in FIG. 6, the cap bolt 47 inserted into the bolt insertion hole 48 of the connection member 10 is fastened to the hexagon nut 44 disposed in the nut arrangement hole 45 in a state in which the wall portion 3*a* of the leg unit 3 is sandwiched between the connection member 10 and the hexagon nut 44 disposed in the nut arrangement hole 45 of the arrangement member 42.

Figures 1, 9:
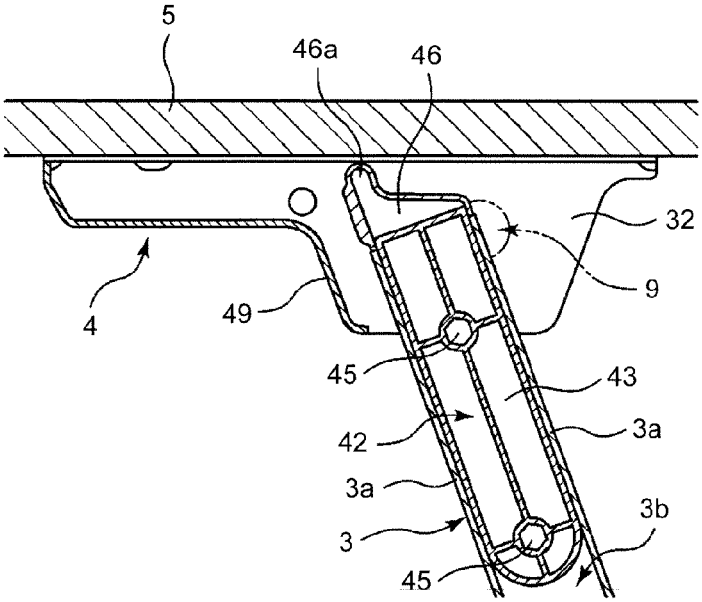
Figures 2, 9:
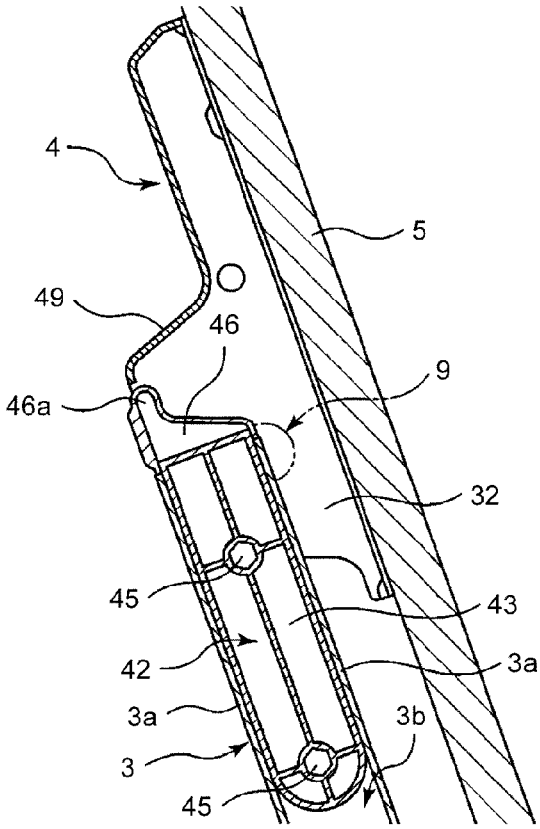

As illustrated in FIGS. 8, 9-1 and 9-2, the bracket 4 includes a front surface plate 49, provided on a front surface side, which hides the blocking portion 46 when the tabletop 5 is in a use position (see FIG. 9-1), and approaches the blocking portion 46 when the tabletop 5 is in a folding position (see FIG. 9-2). The front surface plate 49 hides the blocking portion 46 or approaches the blocking portion 46 regardless of a position of the tabletop 5 ranging from the use position to the folding position, and thus there is no concern that a finger or the like is sandwiched between the front surface plate 49 and the blocking portion 46.

An upper end of the standing piece 46*a* of the blocking portion 46 described above approaches a lower end of the front surface plate 49 when the tabletop 5 is in a folding position. Further, the rotating shaft 9 of the tabletop 5 described above is pivotally supported in the connection member 10 at a position behind the standing piece 46*a* of the blocking portion 46.

Next, a structure of a leg unit of furniture will be described below.

FIG. 1 is a perspective view of the folding table to which the invention is applied when seen from the front in an oblique direction. The folding table 1 includes the pair of left and right leg units 3 and 3 including facing surfaces on top end portions connected to each other by the connection lever 2, and the tabletop 5 attached to the bracket 4 rotatably attached to top end portions of the both leg units 3 such that the tabletop 5 may rotate between a horizontal use position and a standing folding position on a rear side of the leg unit 3.

Figure 10:
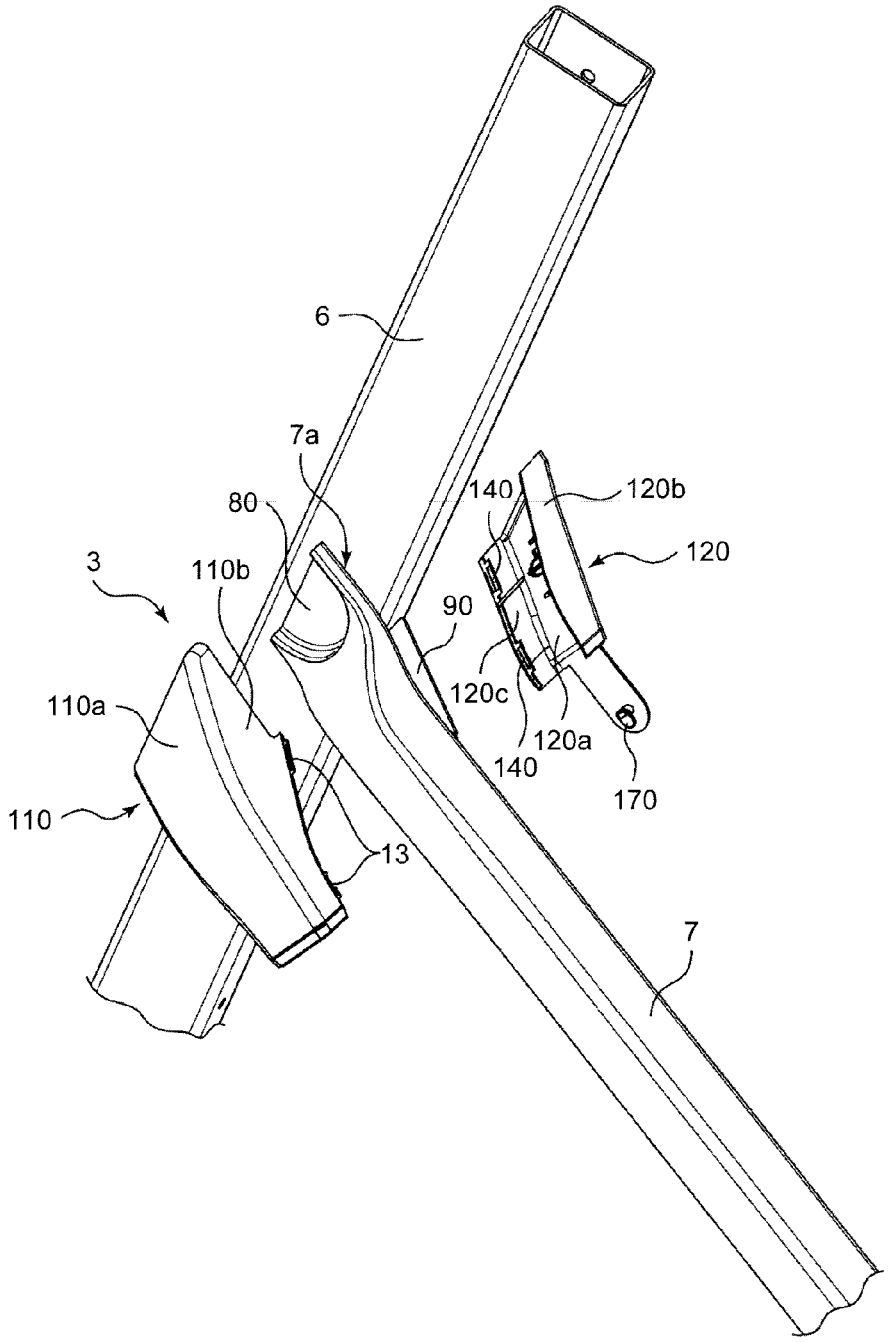
FIG. 10 is an enlarged perspective view when leg units are seen from the outside.
Figure 11:
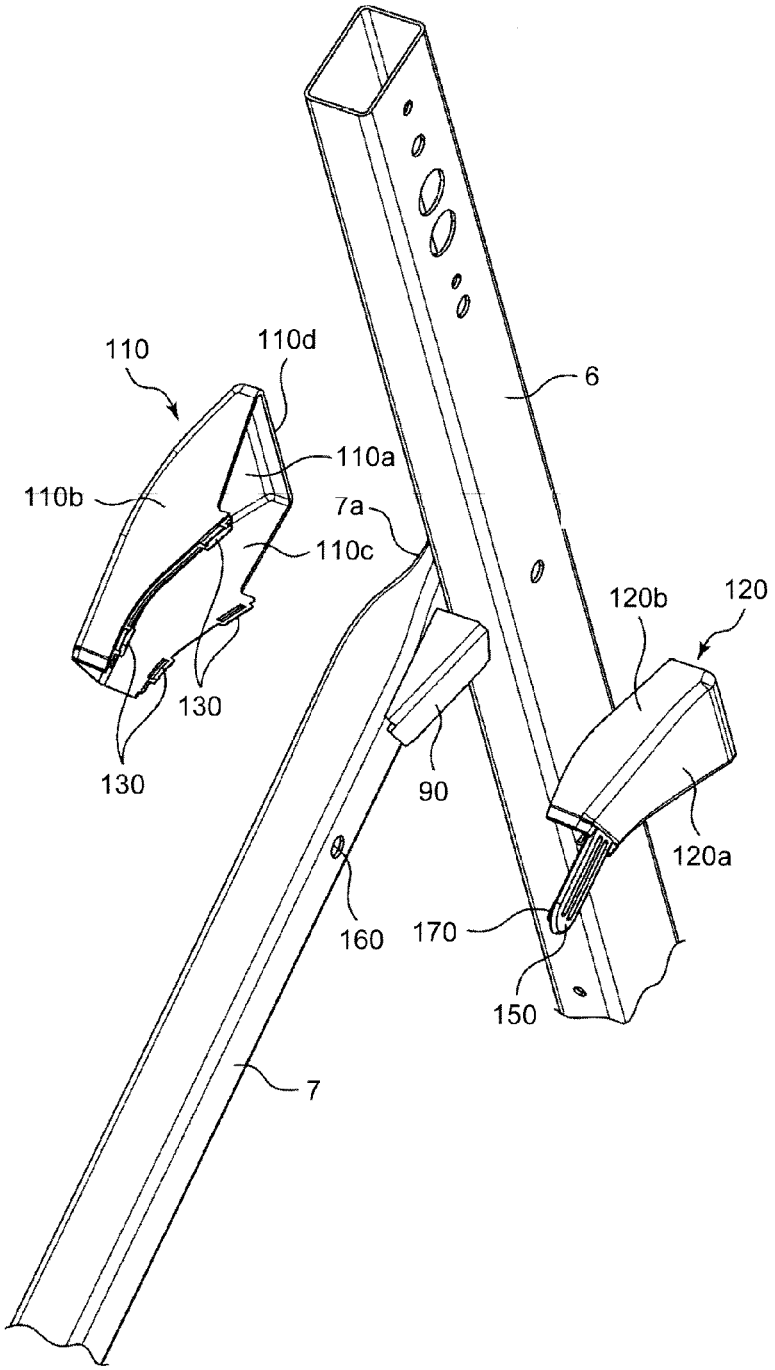
FIG. 11 is an enlarged perspective view when leg units are seen from the inside.

As illustrated in enlarged views of FIGS. 10 and 11 (only left leg unit is illustrated due to bilateral symmetry), the left and right leg units 3 and 3 include the vertical rear leg 6 that inclines toward a front side in an oblique direction, and the front leg 7 facing a front and lower side in an oblique direction and including a top end portion (rear end portion) adhered to an external surface of an intermediate portion in a vertical direction of the rear leg 6 such that an approximate reversed shape of a letter "Y" is formed in lateral view, and the caster 8 is attached to lower ends of the rear leg 6 and the front leg 7. The rear leg 6 and the front leg 7 are formed in a shape of a square tube using metal that may weld the legs together, for example, a metallic material such as iron.

A widened width portion 7*a* having a wider vertical width compared to a lower portion is formed on a top end portion of the front leg 7 by compressing the portion in a left-right direction using a press and the like to perform plastic deformation. The widened width portion 7*a* is shaped into a flat plate having a left-right size (thickness) gradually decreasing toward a rear end, and an inside surface (inside portion) thereof is a vertical surface to come into surface-contact with an external surface (external surface) of the rear leg 6. A front leg concave portion 80 of an external surface of the widened width portion 7*a* is a pressed trace by a press for reducing a thickness of a rear end portion and for shaping the inside surface into a vertical surface.

When the inside surface of the widened width portion 7*a* comes into contact with an external surface of an intermediate portion in a vertical direction of the rear leg 6, and rims of a contact portion of the surfaces are welded together, the top end portion of the front leg 7 is combined with the external surface of the rear leg 6 such that a reversed shape of a letter "Y" is formed in lateral view. In addition to welding the rims of the contact portion, a portion where the front leg concave portion 80 is formed may be adhered by spot welding and the like. In this way, it is possible to solidly combine the widened width portion 7*a* with the rear leg 6.

In a connected portion of the rear leg 6 and the front leg 7, a front surface and an inside surface thereof are combined together by a reinforced member 90 having a shape of a right-angled triangle in planar view in which a left-right size gradually decreases from a rear end toward a front end (see FIG. 11). That is, when a rear end surface and an external surface of the reinforced member 90 are welded to the front surface of the rear leg 6 and the inside surface of the front leg 7, respectively, the front surface and the inside surface thereof are combined together. A connected portion of the rear leg 6, the front leg 7, and the reinforced member 90 is covered with a cover member 100 made of a synthetic resin.

As illustrated in FIGS. 10 to 13, the cover member 100 is divided into two left and right members which are a first cover member 110 that covers a top end portion including the widened width portion 7*a* of the front leg 7 from the outside, and a second cover member 120 that covers the reinforced member 90 from the inside.

The first and second cover members 110 and 120 include side pieces 110*a* and 120*a*, upper pieces 110*b* and 120*b*, and lower pieces 110*c* and 120*c*, respectively, and longitudinal cross-sectional profiles form a shape of a letter "U" facing each other. A short rear piece 110*d* that covers the widened width portion 7*a* from the rear is connected to a rear end of the first cover member 110 toward the inside.

As described in the foregoing, when the widened width portion 7*a* is shaped into a flat plate having a left-right size gradually decreasing toward a rear end, the side piece 110*a* of the first cover member 110 is gradually inclined inward toward a rear end, which enables a left-right width of a portion that covers the widened width portion 7*a* of the first cover member 110 to gradually decrease toward the rear end. In this way, the portion that covers the widened width portion 7*a* of the first cover member 110 does not greatly protrude outward, and thus there is less concern that an object touches the portion, and the appearance is improved.

The second cover member 120 covers the reinforced member 90 from the inside, thereby coming into contact with and being attached to the front surface of the rear leg 6 and the inside surface of the front leg 7, and an inside surface thereof, that is, the side piece 120*a* is gradually inclined outward from a rear end toward a front end. In this way, when the side piece 120*a* is inclined, and a plurality of folding tables 1 are kept in a state of overlapping each other in a front-rear direction, there is less concern that the left and right rear legs 6 of a front table touches the side pieces 120*a* of the second left and right cover members 120 of a rear table, and thus the rear leg 6 and the second cover member 120 are rarely scratched, and nesting is efficiently performed by causing the front and rear tables to approach each other.

Figure 13:
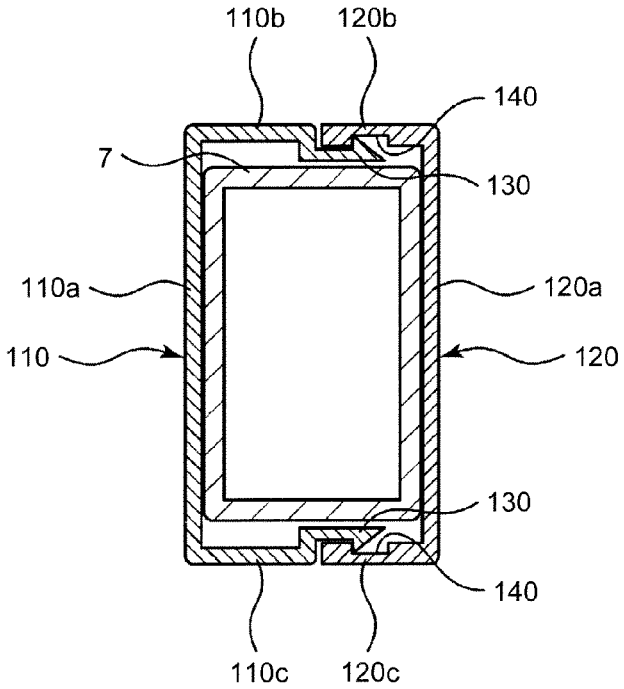
FIG. 13 is an enlarged longitudinal cross-sectional view taken along line IV-IV of FIG. 1.

As illustrated in FIGS. 11 and 13, two front and two rear locking stops 130 and 130 elastically deformable in a vertical direction which protrudes inward are connected to a right rim of a first half portion of the upper piece 110*b* and the lower piece 110*c* in the first cover member 110. In addition, two front and two rear engagement grooves 140 that may be engaged with the respective locking stops 130 and 130 of the first cover member 110 are formed on an inner surface of a left end portion of the upper piece 120*b* and the lower piece 120*c* in the second cover member 120.

Figure 12:
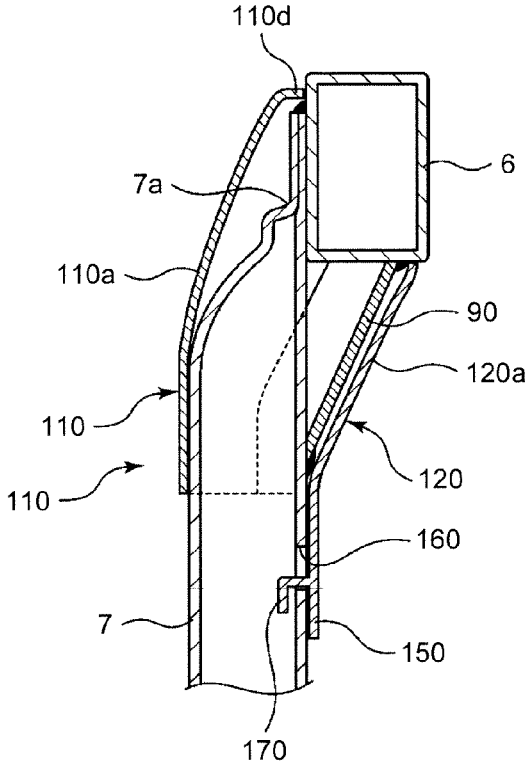
FIG. 12 is an enlarged horizontal cross-sectional view of a connected portion of a rear leg and a front leg.

A positioning piece 150 protrudes downward in an oblique direction on a lower end of the side piece 120*a* of the second cover member 120, and a locking hook 170, which has a cross-sectional surface of a downward hook and may be locked to an engagement hole 160 formed on an inside surface of the front leg 7, protrudes on an external surface of a lower end portion of the positioning piece 150 as illustrated in FIG. 12. It is preferable that the positioning piece 150 may be elastically deformed in a thickness direction based on a proximal end so that the locking hook 170 is easily locked to the engagement hole 160.

First, the first cover member 110 is put on the top end portion including the widened width portion 7*a* of the front leg 7 from the outside to mount the first and second cover members 110 and 120.

Next, the locking hook 170 of the positioning piece 150 in the second cover member 120 is engaged with the engagement hole 160 of the front leg 7, and the second cover member 120 is positioned in a longitudinal direction of the front leg 7. In this state, the second cover member 120 is put on the reinforced member 90 from the inside, and each locking stop 130 of the first cover member 110 is elastically engaged with each engagement groove 140 provided in the upper piece 120*b* and the lower piece 120*c* of the second cover member 120 as illustrated in FIG. 13. In this way, the first cover member 110 and the second cover member 120 are connected to each other, and the connected portion of the rear leg 6, the front leg 7, and the reinforced member 90 is covered with the first and second cover members 110 and 120.

Hereinbefore, in the folding table 1 according to the embodiment, the protruding portion 26 that protrudes in the horizontal direction is integrally formed on the bracket 4. By providing, on the upper portion of the leg units 3, the fitting hole 27 into which the protruding portion 26 fits and fitting the protruding portion 26 into the fitting hole 27 while crimping the distal end of the protruding portion 26 in the horizontal direction, the bracket 4 is connected to the leg units 3, and the tabletop 5 is rotated using the protruding portion 26 as the rotating shaft 9. The tabletop 5 may be connected to the leg units 3 through an operation of crimping the distal end of the protruding portion 26 by fitting the protruding portion 26, which is integrally formed with the bracket 4, to the fitting hole 27 on the upper portion of the leg units 3, and thus the work of installing the leg units 3 on the tabletop 5 may be simplified. In addition, when the protruding portion 26 is crimped in the horizontal direction, a deformation direction due to the crimping is different from a direction in which a load of the tabletop 5 is applied in the protruding portion 26, and a portion deformed by the crimping is less influenced at the time of rotating the tabletop 5 in the protruding portion 26. Accordingly, squeaking and rattling are prevented even when the tabletop is used for a long period of time, and the tabletop 5 may be rotated smoothly.

In addition, the connection member 10 is provided on the upper portion of the leg units 3, the connection member 10 includes the pair of left and right board members 22 and 23 connected to each other, in which corresponding circular openings 28 and 29 having a circular shape are formed, and the both circular openings 28 and 29 serve as the fitting hole 27. In general, the leg units 3 are formed by an extrusion molding of a rigid body and the like to support a load of the tabletop 5 and the like. The connection member 10 may be formed as a different member from the leg units 3 in the invention even though design accuracy fluctuates. In addition, when the circular openings 28 and 29 are formed in the pair of left and right board members 22 and 23, it is possible to open the fitting hole 27 having high design accuracy.

In addition, when the space portion 30 is formed between the pair of left and right board members 22 and 23, the connection member 10 has a thickness, and thus a light connection member 10 may be formed while strength of the connection member 10 is enhanced.

In addition, when the edge of the circular opening 29 of at least one board member 23 of the both board members 22 and 23 is extended in a horizontal direction, the inner periphery of the fitting hole 27 may be widely formed, and the tabletop 5 may be smoothly rotated by supporting a load applied to the inner periphery of the fitting hole 27 from the protruding portion 26 in a large area.

In addition, when the edge of the circular opening 29 of at least one board member 23 of the both board members 22 and 23 is extended toward the other board member 22, and comes into contact with the other board member 22, a neighborhood of the fitting hole 27 of the connection member 10 provided with the space portion 30 therein is rarely crushed in a thickness direction of the connection member 10, and strength is enhanced.

Heretofore, in a folding table in a table (desk) used in an office and the like, hole portions are formed in both a bracket connected to a tabletop and a connection board connected to leg units, and a pivot is inserted into the hole portions, so that the tabletop is rotatably supported by the leg units, and locking grooves provided in two places of a locking plate (engaging unit) are locked in locking pins (lock pins) provided on a supporting surface of the leg units, respectively, so that the tabletop may not rotate in a vertical state (use position) and a perpendicular state (folding position) (for example, see Japanese Patent Application Laid-open No. 2006-102012). In addition, locking pins (lock pins) are provided in two places of a leg lever (leg unit) (for example, see Japanese Patent Application Laid-open No. 9-191941).

However, in the table of Japanese Patent Application Laid-open No. 2006-102012 and Japanese Patent Application Laid-open No. 9-191941, when an external force is applied to a tabletop while a locking plate (engaging unit) is locked in a locking pin (lock pin), the external force is applied to a pivot, and is applied to the locking pin through the locking plate. In particular, stress is easily concentrated on a base (base portion) of the locking pin. When the table is used for a long period of time, there is an issue that metallic fatigue and the like occurs in the base of the locking pin.

In regard to the folding table according to the embodiment, in the folding table 1 in which the tabletop 5 is pivotally supported about a shaft center facing a left-right direction on an upper portion of the leg unit 3, the tabletop 5 may rotate between a horizontal use position and a standing folding position, and the tabletop 5 may not rotate in a use position and a folding position by disengaging the engaging unit provided in the tabletop 5 from the locking unit provided in the leg unit, the locking unit includes the connection member 10 which includes the pair of left and right board members 22 and 23 connected to each other, and is connected to an upper portion of the leg unit 3, and the lock pin 21 which is non-detachably fitted to the hole portions 33 and 34 corresponding to each other formed in the both board members 22 and 23, and includes at least one end laterally protruding from the board members 22 and 23, and from which the locking lever 12 is disengaged. As a result, the lock pin 21 is held at two parts in an axial direction thereof by the hole portions 33 and 34 corresponding to each other of the pair of left and right board members 22 and 23. Even when an external force is applied to the tabletop 5, and the external force is applied to the lock pin 21 through the locking lever 12, it is possible to prevent stress from being concentrated on a part in the axial direction of the lock pin 21, and enhance durability of the lock pin 21. In addition, the hole portions 33 and 34 that hold the lock pin 21 in two parts of the axial direction may be easily formed using the pair of left and right board members 22 and 23 connected to each other.

In addition, when the base portion 21*a* of a protruding portion of the lock pin 21 is caused to bulge out and is fixed to the hole portions 33 and 34 by crimping one end of the lock pin 21 in an axial direction thereof, it is possible to facilitate the work of attaching the lock pin 21 to the connection member 10 through an operation of fitting and crimping the lock pin 21 to the hole portions 33 and 34 of the connection member 10. Moreover, since the base portion 21*a* of the protruding portion of the lock pin 21 bulges out, metallic fatigue and the like occurring in the lock pin 21 may be prevented even when stress is applied to the base portion 21*a*.

In addition, when the space portion 30 is formed between the pair of left and right board members 22 and 23, two parts holding the lock pin 21 are separated from each other through the space portion 30, thereby dispersing stress applied to the lock pin 21 and preventing metallic fatigue and the like, and the connection member 10 has a thickness, and thus it is possible to form the light connection member 10 while enhancing strength of the connection member 10.

In addition, when the leg units 3 form a left and right pair, the connection lever 2 is provided to connect the connection members 10 of the respective leg units 3, and the reinforced plate 40 is disposed at a position where the connection lever 2 is screwed in the space portion 30, it is possible to locally reinforce, by the reinforced plate 40, a part where a load is applied due to the connection lever 2 connected to the connection member 10, and form a light connection member 10 while enhancing strength of the connection member 10.

In addition, the reinforced plate 40 may resist a force applied in a direction in which the space portion 30 is crushed with respect to the connection member 10 by coming into contact with the pair of left and right board members 22 and 23, respectively.

Heretofore, there is a table (furniture) used in an office and the like including a crossbar (connection lever) that connects the left and right leg units to each other on the lower side of a tabletop (for example, see Japanese Patent Application Laid-open No. 2006-102012).

However, in regard to the table (furniture) of Japanese Patent Application Laid-open No. 2006-102012, the crossbar (connection lever) is connected by a bolt (external thread member) inserted into an insertion hole formed in the leg units, and stress is applied in a direction in which the leg units including a round pipe and the like is crushed when the bolt is fastened. There is an issue that metallic fatigue and the like occurs in a neighborhood of the insertion hole of the leg units due to remaining stress.

In regard to the leg unit 3 of the folding table (furniture) 1 according to the embodiment, in the leg unit 3 of furniture provided with the connection lever 2 that connects a pair of left and right leg units each other, the leg unit 3 includes the wall portion 3*a* and the hollow portion 3*b* surrounded by the wall portion 3*a*, the arrangement member 42 non-rotatably disposing the hexagon nut 44 is inserted into the hollow portion 3*b*, the insertion hole 3*d*, into which the cap bolt 47 screwed to the hexagon nut 44 is inserted, is formed in the wall portion 3*a*, the insertion hole 3*d*, into which the cap bolt 47 is inserted, is formed in the connection member 10 connected to an end portion of the connection lever 2 and extending in a longitudinal direction of the leg unit 3, and the cap bolt 47 is fastened to the hexagon nut 44 in a state in which the wall portion 3*a* is sandwiched between the connection member 10 and the hexagon nut 44. As a result, when the cap bolt 47 is fastened, the wall portion 3*a* of the leg unit 3 is sandwiched between the connection member 10 and the hexagon nut 44, and connection power may be enhanced. Moreover, there is no concern that the hollow leg unit 3 is crushed or deformed due to the fastened cap bolt 47. Thus, it is possible to prevent stress from remaining in a neighborhood of the insertion hole 3*d* of the leg unit 3, and enhance durability of the leg unit 3.

Since the insertion hole 3*d* is only formed in the wall portion 3*a* on the inside of the leg unit 3, the cap bolt 47 or the hexagon nut 44 used to connect the leg unit 3 and the connection member 10 to each other is not exposed to the outside of the leg unit 3, and thus appearance of the folding table 1 may be enhanced.

In addition, the top surface opening 3*c* leading to the hollow portion 3*b* is formed on the upper surface of the leg unit 3, the arrangement member 42 is inserted into the hollow portion 3*b* from the top surface opening 3*c*, and the upper portion of the arrangement member 42 is the blocking portion 46 that blocks the top surface opening 3*c*. As a result, it is possible to position the arrangement member 42 by the blocking portion 46 of the arrangement member 42, easily perform the work of fastening the cap bolt 47, and enhance appearance of the leg unit 3 by blocking the top surface opening 3*c* of the leg unit 3.

In addition, the furniture includes the folding table 1 in which the bracket 4 is pivotally supported about the shaft center facing a horizontal direction on the upper portion of the leg unit 3, the bracket 4 is connected to the lower surface of the tabletop 5 to support the tabletop 5, and the tabletop 5 may rotate between a horizontal use position and a standing folding position, the blocking portion 46 protrudes upward from the top surface opening 3*c*, and the bracket 4 includes the front surface plate 49 which hides the blocking portion 46 or approaches the blocking portion 46 in a range from the use position to the folding position. As a result, the blocking portion 46 is hidden by the front surface plate 49 of the bracket 4 or the front surface plate 49 approaches the blocking portion 46 regardless of a position of the tabletop 5 ranging from the use position to the folding position, and thus there is no concern that a foreign substance is sandwiched between the blocking portion 46 and the bracket 4.

In addition, the blocking portion 46 forms an approximate shape of a letter "L" in lateral view including the standing piece 46*a* that stands upward on a front side thereof, and the upper end of the standing piece 46*a* and the lower end of the front surface plate 49 approaches each other in the folding position. As a result, there is no concern that a foreign substance is sandwiched between the standing piece 46*a* and the front surface plate 49 when the tabletop 5 is in the folding position, the standing piece 46*a* and the front surface plate 49 are integrally connected to each other, and appearance of a periphery of the upper portion of the leg unit 3 is enhanced.

In addition, when the tabletop 5 is pivotally supported by the leg unit 3 at a position behind the standing piece 46*a*, it is possible to protect a member included in the rotating shaft 9 (shaft center) pivotally supporting the tabletop 5 and the like (the protruding portion 26, the fitting hole 27, and the like) by the standing piece 46*a*.

There is a table including a foldable tabletop in which left and right leg units include a vertical rear leg facing a front side in an oblique direction, and a front leg that inclines in a front and lower side, a distance at which the left and right front legs are separated from each other is greater than a distance at which the left and right rear legs are separated from each other by fixing the front leg at a position on the outside of the rear leg in a top end portion or a lower end portion of the rear leg, so that a nest of a plurality of tables and the like overlapping each other from a front-rear direction may be kept in a state in which the tabletop is folded (for example, see Japanese Patent Application Laid-open No. 2006-102012, Japanese Patent Application Laid-open No. 2007-260286, and Japanese Patent Application Laid-open No. 2007-301302).

In the leg unit of the table disclosed in Japanese Patent Application Laid-open No. 2006-102012, the top end portion of the front leg is simply fixed to the external surface of the top end portion of the rear leg by the screw. Thus, there is a concern that the leg unit shakes in a case where the screw is loosened.

In the leg unit of the table disclosed in Japanese Patent Application Laid-open No. 2007-260286, the vertical concave portion is provided on the external surface of the rear leg, and the top end portion of the front leg is fitted into the concave portion and is screwed shut. Thus, there is less concern that the leg unit immediately shakes even when the screw is loosened. However, the concave portion is needed to be provided in the rear leg, and the fitting member that may be fitted to the concave portion is needed to be adhered to the top end portion of the front leg. Thus, a structure of the leg unit is complicated, and a manufacturing cost increases.

In the leg unit of the desk disclosed in Japanese Patent Application Laid-open No. 2007-301302, the rear end portion of the front leg is fitted to the lower end portion of the rear leg from the outside, and the rear leg is merely sandwiched by the plate-like fixed member threadably mounted on the fitted portion from the inside. Thus, strength of attaching the front leg to the rear leg is small, and it is disadvantageous in terms of strength since a load of the tabletop and the like is applied to the attached portion as a great bending moment.

In addition, all of the leg units of Japanese Patent Application Laid-open No. 2006-102012, Japanese Patent Application Laid-open No. 2007-260286, and Japanese Patent Application Laid-open No. 2007-301302 have poor appearance since the connected portion of the front leg and the rear leg, the screw, and the like are exposed to the outside.

In regard to the leg unit 3 of the folding table (furniture) 1 of the Example, in the leg unit 3 of furniture including the vertical rear leg 6 and the front leg 7 facing a front and lower side in an oblique direction and including the top end portion adhered to an intermediate portion in a vertical direction of the vertical rear leg 6, the widened width portion 7*a* having a wider vertical width compared to a lower portion and capable of coming into surface-contact with the outside portion or the inside portion of the rear leg 6 is formed on a top end portion of the front leg 7 by compressing the portion in a left-right direction to perform plastic deformation, the widened width portion 7*a* is combined with the outside portion or the inside portion of the intermediate portion in a vertical direction of the rear leg 6, and the front surface of the rear leg 6 and the inside portion or the outside portion of the front leg 7 are combined together by the reinforced member 90. Without performing special processing and the like on the rear leg 6, the widened width portion 7*a* having a wider vertical width compared to a lower portion is merely formed on the top end portion of the front leg 7 by performing plastic deformation through compressing, and the widened width portion 7*a* merely comes into surface-contact with and is combined with the outside portion of the rear leg 6. Thus, it is possible to simplify a structure of the rear leg 6 and the front leg 7, and reduce a cost of the leg unit 3. In addition, a contact area and a binding region of the widened width portion 7*a* with respect to the rear leg 6 increase, and the front surface of the rear leg 6 and the inside portion or the outside portion of the front leg 7 are combined together by the reinforced member 90, and thus bond strength of the rear leg 6 and the front leg 7 increases.

In addition, the rear leg 6 and the front leg 7 are formed in a shape of a square tube, and the widened width portion 7*a* of the front leg 7 is formed in a flat plate having a left-right size gradually decreasing toward the rear end. The widened width portion 7*a* of the front leg 7 may come into surface-contact with the rear leg 6 on a large area to be combined in a wide range, and thus bond strength of the rear leg 6 and the front leg 7 further increases.

In addition, when the connected portion of the rear leg 6, the front leg 7, and the reinforced member 90 is covered by the cover member 100, a welded portion or the connected portion of the rear leg 6, the front leg 7, and the reinforced member 90 is hidden by the cover member 100, and is not exposed to the outside, and thus appearance of the leg unit 3 is improved.

In addition, when a left-right width of a portion that covers the widened width portion 7*a* of the cover member 100 gradually decreases toward the rear end, the portion that covers the widened width portion 7*a* of the cover member 100 does not greatly protrude outward, and thus there is less concern that an object touches the portion, and the appearance is improved.

In addition, when the inside surface of a portion that covers the reinforced member 90 of the cover member 100 from the inside is an inclined surface that gradually inclines outward from the rear end toward the front end, and, for example, a plurality of the folding tables 1 in which the tabletops 5 are foldable are kept in a state of overlapping each other in a front-rear direction, there is less concern that the left and right rear legs 6 of a front folding table 1 touches the inside surface of the left and right cover members 100 in the rear table, and thus the rear leg 6 and the cover member 100 are rarely scratched, and nesting is efficiently performed by causing the front and rear folding tables 1 to approach each other.

In addition, the cover member 100 is divided into two left and right members which are the first cover member 110 that covers the widened width portion 7*a* of the front leg 7, and the second cover member 120 that covers the reinforced member 90. Herein, one of opposed end faces of the first cover member 110 and the second cover member 120 is provided with the engagement groove 140, and the other opposed end face is provided with the locking stop 130 engaged with the engagement groove 140. That is, the cover member 100 is divided into two left and right members which are the first cover member 110 and the second cover member 120, and the locking stop 130 and the engagement groove 140 provided in an opposed portion of the upper pieces 110*b* and 120*b* and the lower pieces 110*c* and 120*c* are engaged with each other, thereby enabling the first cover member 110 and the second cover member 120 to be connected to each other. Thus, the first cover member 110 and the second cover member 120 may be connected to each other, and be easily mounted to the connected portion of the rear leg 6, the front leg 7, and the reinforced member 90 from a left-right direction.

In the embodiment, the widened width portion 7*a* of the front leg 7 is combined with the external surface of the rear leg 6. However, the widened width portion 7*a* may be combined with the inside surface of the rear leg 6. In this instance, the reinforced member 90 is combined with the front surface of the rear leg 6 and the external surface of the front leg 7.

In addition, in the embodiment, the rear leg 6 and the front leg 7 are formed in a shape of a square tube to increase a contact area of the connected portion. However, a circular pipe, an ellipsoidal pipe, and the like may be used. In this instance, a lateral face (lateral portion) facing the external surface (external portion) (or internal surface (internal portion) of the rear leg 6 in the widened width portion 7*a* may have a curved surface shape such as a round pipe and an ellipsoidal pipe capable of coming into surface-contact with the rear leg.

Hereinbefore, the embodiment of the present invention is described based on drawings. However, a specific configuration is not limited to the embodiment, and a change and an addition within the scope of the invention are included in the invention.

For example, in the embodiment, the edge of the circular opening 29 of the board member 23 on the right side (inside) is extended in a horizontal direction toward the edge of the circular opening 28 of the board member 22 on the left side (outside), thereby forming a wide inner periphery of the fitting hole 27. However, even when the edge of the circular opening 29 is extended toward the opposite side of the board member 22, a wide inner periphery of the fitting hole 27 may be formed.

In addition, for example, in the embodiment, the connection member 10 is provided with two lock pins 21 on the upper side and the lower side. However, the number of the lock pins 21 is not particularly limited, and a single lock pin 21 may be provided in the connection member 10. In this case, two upper and lower lock grooves may be formed on the locking lever.

In addition, for example, in the embodiment, the invention is applied to the folding table 1. However, the invention is not limited to the folding table 1 including the rotating shaft 9 that rotates the tabletop 5, and maybe applied to a general table in which the tabletop 5 does not rotate.

In addition, in the embodiment, the insertion hole 3*d* is formed in the wall portion 3*a* on the inside of the leg unit 3. However, the insertion hole may be formed in the wall portion 3*a* on the outside of the leg unit 3, thereby connecting the connection member 10 from the outside of the leg unit 3.

In addition, for example, the structure of the leg unit is not limited to the folding table 1 according to the embodiment, and may be applied to a leg unit of a normal table or desk in which a tabletop is fixed.

In addition, in the embodiment, the widened width portion 7*a* of the front leg 7 and the external surface of the rear leg 6 come into contact with each other, and are combined together by welding the rim of the contact portion. However, a combining unit is not limited to welding. For example, the widened width portion 7*a* and the external surface of the rear leg 6 may be combined together through a screw member such as a screw by using a size of the area of the widened width portion 7*a*.

REFERENCE SIGNS LIST

1 FOLDING TABLE (FURNITURE)
2 CONNECTION LEVER
3 LEG UNIT
3*a* WALL PORTION
3*b* HOLLOW PORTION
3*c* TOP SURFACE OPENING
3*d* INSERTION HOLE
4 BRACKET
5 TABLETOP
6 REAR LEG
7 FRONT LEG
9 ROTATING SHAFT
10 CONNECTION MEMBER (LOCKING UNIT)
10*a* HORIZONTAL SURFACE
10*b* THIN WALL PORTION
12 LOCKING LEVER (ENGAGING UNIT)
20 LOCK GROOVE
21 LOCK PIN (LOCKING UNIT)
21*a* BASE PORTION

22, 23 BOARD MEMBER
24 HORIZONTAL PIECE
25 DOWNWARD PIECE
26 PROTRUDING PORTION
27 FITTING HOLE
28, 29 CIRCULAR OPENING
30 SPACE PORTION
32 COVER PIECE
33, 34 HOLE PORTION
40 REINFORCED PLATE
42 ARRANGEMENT MEMBER
44 HEXAGON NUT (INTERNAL THREAD MEMBER)
46 BLOCKING PORTION
46*a* STANDING PIECE
47 CAP BOLT (EXTERNAL THREAD MEMBER)
48 BOLT INSERTION HOLE
49 FRONT SURFACE PLATE
80 FRONT LEG CONCAVE PORTION
90 REINFORCED MEMBER
100 COVER MEMBER
110 FIRST COVER MEMBER
120 SECOND COVER MEMBER
130 LOCKING STOP
140 ENGAGEMENT GROOVE
150 POSITIONING PIECE
160 ENGAGEMENT HOLE
170 LOCKING HOOK

The invention claimed is:

1. A folding table comprising:

a tabletop;

a leg unit; and a bracket supported by an upper portion of the leg unit and connected to a lower surface of the tabletop to support the tabletop, the bracket being supported pivotally about a shaft center extending a horizontal direction to allow the tabletop to rotate between a horizontal use position and a standing folding position, wherein the bracket has an integrally-formed protruding portion protruding in the horizontal direction, wherein the upper portion of the leg unit includes a fitting hole into which the protruding portion of the bracket fits, the bracket is connected to the leg unit by inserting the protruding portion into the fitting hole and crimping a distal end of the protruding portion in the horizontal direction, and the tabletop is rotatably supported by the protruding portion as a rotating shaft.

2. The folding table according to claim 1, wherein a connection member is provided on the upper portion of the leg unit, the connection member includes a pair of left and right board members connected to each other in which corresponding circular openings having a circular shape are formed, and the both circular openings serve as the fitting hole.

3. The folding table according to claim 2, wherein a space portion is formed between the pair of left and right board members.

4. The folding table according to claim 3, wherein an extension portion extends in the space portion in the horizontal direction from an edge of a circular opening of at least one board member of the both board members.

5. The folding table according to claim 4, wherein the extension portion extends toward the other board member, and comes into contact with the other board member.

* * * * *